US005223369A

United States Patent [19]

Mammino et al.

[11] Patent Number: 5,223,369

[45] Date of Patent: Jun. 29, 1993

[54] PROCESS FOR COATING CARRIER PARTICLES

[75] Inventors: Joseph Mammino; Deepak R. Maniar, both of Penfield, N.Y.

[73] Assignee: Xerox Corporation, Stamford, Conn.

[21] Appl. No.: 851,589

[22] Filed: Mar. 16, 1992

[51] Int. Cl.[5] ..... G03G 9/113

[52] U.S. Cl. ..... 430/137; 427/221

[58] Field of Search ..... 430/108, 137; 427/215, 427/216, 221

[56] References Cited

U.S. PATENT DOCUMENTS

| | | | |
|---|---|---|---|
| 3,507,686 | 4/1970 | Hagenbach | 430/108 |
| 3,533,835 | 10/1970 | Hagenbach et al. | 430/108 |
| 3,590,000 | 6/1971 | Palermiti et al. | 430/110 |
| 3,873,356 | 3/1975 | Queener et al. | 430/137 |
| 4,209,550 | 6/1980 | Hagenbach et al. | 430/108 |
| 4,233,387 | 11/1980 | Mammino et al. | 430/137 |
| 4,828,956 | 5/1989 | Creatura et al. | 430/137 |
| 5,102,769 | 4/1992 | Creatura | 430/137 |

FOREIGN PATENT DOCUMENTS

| | | | |
|---|---|---|---|
| 1148785 | 6/1983 | Canada | 430/108 |
| 92134 | 8/1978 | Japan | 430/108 |
| 86387 | 5/1982 | Japan | 430/137 |
| 164053 | 7/1987 | Japan | 430/137 |

OTHER PUBLICATIONS

"Polyvinyl Fluoride", (IP 901160) J. J. Dietrich et al., *Paint and Varnish Production,* Nov. 1966, pp. 75–89.

"Optical Properties Spectral Transmission", E. I. du-Pont de Nemours & Co. (Inc.), Polymer Products Department, *Tedlar PVF Film Technical Bulletin.*

"Solvents for Kynar", Pennwalt Chemicals Equipment Health Products, *Technical Data,* Jan. 31, 1974.

*Primary Examiner*—Roland Martin

*Attorney, Agent, or Firm*—Oliff & Berridge

[57] ABSTRACT

Small amounts of a latent solvent are added during the initial powder impaction of the powder coating process of toner carrier particles so as to avoid excessive heating. The temperature of the mixture is raised until the solvent softens the polymer, thereby making the coating uniform. Solvent is later removed to obtain the dry coated carrier. The process is especially useful when using coating materials which have a thermal processing narrow temperature range.

29 Claims, No Drawings

PROCESS FOR COATING CARRIER PARTICLES

FIELD OF THE INVENTION

This invention relates to an improved process for coating carrier particles. The process is particularly applicable in the preparation of electrostatographic toner carrier particles.

BACKGROUND

Images may be formed and developed on the surface of photoconductive and insulating materials by electrostatic methods. An electrostatic latent charged image is formed on an insulating electrostatographic element and the latent image is rendered visible by a development step, wherein the latent image element is brought into contact with a developer mixture. In electrophotography, a photoconductor is charged and then exposed imagewise to light. In the area of the photoconductor exposed to light, the charge dissipates or decays while the dark areas retain the electrostatic charge. The resultant latent electrostatic image on the photoconductor may be developed by depositing toner particles over the surface of the photoconductor with the toner particles having a charge so as to be directed by the electrical fields to the image areas of the photoconductor to develop the electrostatic image, suitably biased to deposit toner on the discharged areas of the photoconductor. Subsequently, the toner image can be transferred to a support surface such as paper where it can be permanently affixed to the support surface using a variety of techniques including pressure fixing, heat fixing, solvent fixing and the like.

Developer material, comprising relatively large carrier particles having finely divided toner particles electrostatically clinging to the surface of the carrier particles, is conveyed to and contacted with the electrostatic latent image bearing surface. The toner particles are attracted to the electrostatic latent image by electrostatic attraction.

Carrier materials used in the development of electrostatic latent images are described in many patents including, for example, U.S. Pat. No. 3,590,000 (Palermiti et al.). The type of carrier material used depends on many factors such as the type of developer used, the quality of the development desired, the type of photoconductive material employed, and the like. Generally, carrier particles or the coating thereon should have a triboelectric value commensurate with the triboelectric value of the toner in order to generate electrostatic adhesion of the toner to the carrier. The toner and carrier particles of the developer material are selected so that the toner obtains the correct charge polarity and magnitude to insure that the toner particles are preferentially attracted to the desired image areas of the photoconductor. If the triboelectric charge is too low, the copy will be characterized by high print density but heavy background; if the charge is too high, the background is good but the print density will tend to be low. Thus, there is an optimum range of toner charge for best overall results.

Some dry developer materials which are employed in automatic copying machines, have carrier filming problems, due to the recycling of the carrier particles through many cycles producing many collisions between the carrier particles and between the carrier particles and parts of the machine. The attendant mechanical friction causes some toner material to form a physically adherent film on the surfaces of the carrier particles which impairs the normal triboelectric charging of the toner particles in the developer mix, resulting in a less highly charged toner. The improperly charged toner particles can be deposited on non-image areas, impairing the quality of the copies.

When toner filming occurs to a sufficient degree, the entire developer material must be replaced, increasing the cost of the operation of the machine. Furthermore, because of the contact between the carrier particles and between the carrier particles and parts of the machine, there is abrasion of the coating of the carrier particles. Even if the coating of the carrier particle resists abrasion, the coating must have good adhesion to the core of the carrier particle; otherwise, the coating can chip, flake, or spall, requiring early replacement of the developer material. This abrasion and wearing of the coating also may reduce the effectiveness of the triboelectric charging between the carrier and the toner by exposing the toner to the core material of the carrier.

Therefore, in addition to having the proper triboelectric characteristics, the coating of a carrier particle must have good anti-stick (low surface energy) properties to prevent filming of the carrier particle by the toner, good adherence to the core and be resistant to abrasion. Fluoropolymers such as fluorocarbons and fluorosilicones, for example, are materials having good anti-stick properties to prevent or greatly inhibit toner filming thereon as well as being capable of adhering to a core and resisting abrasion. It has previously been suggested in U.S. Pat. No. 3,533,835 (Hagenbach et al.) to employ fluorocarbons such as polytetrafluoroethylene as a coating for a carrier particle if finely-divided conductive particles are impacted into the coating. However, polytetrafluoroethylene has been described as being at or near the bottom of any published triboelectric series.

U.S. Pat. No. 3,873,356 (Queener et al.) discloses a method of coating a mixture of fluorocarbon and a modifying material on a carrier core particle so that the carrier core particle has the characteristic of being triboelectrically positive with respect to many toners. The modifying resin in which the fluoropolymer is essentially insoluble may be an epoxy resin, a urethane resin, or a methyl phenyl silicone resin. Because of the fluorocarbon in the mixture, the coating of the carrier particle has desired properties of resistance to abrasion, adherence to the core, and an antistick surface so that the filmed layer of toner cannot form thereon while still having the characteristic of being triboelectrically positive with respect to various toners. This is achieved by heating the coated carrier particles at a temperature at which the coating adheres to the core and becomes triboelectrically positive with respect to various toners. The coating may be applied to the core by any suitable means such as dipping, spraying, tumbling the cores with a coating solution in a barrel, or through a fluidized bed.

U.S. Pat. No. 4,233,387 (Mammino et al.) discloses dry mixing of carrier particles with thermoplastic resin particles until the thermoplastic resin particles adhere to the carrier core particles by mechanical impaction and/or electrostatic attraction. The dry mixture is then heated to a temperature of between 320° F. and about 650° F. for between 120 minutes and about 20 minutes so that the thermoplastic resin particles melt and fuse to the carrier core particles. After fusion of the resin particles to the carrier core particles, the coated carrier particles are cooled and classified to the desired particles size. The resultant coated carrier particles have a fused resin coating over between about 15 percent and up to about 85 percent of their surface area.

U.S. Pat. No. 4,209,550 (Hagenbach et al.) discloses a method of coating carrier materials by electrostatically attracting particles of a coating material to the surface of carrier cores and then heating the carrier materials, causing the coating material to fuse to the carrier material forming an adherent coating thereon.

Materials which may be used to coat the carrier core particles include but are not limited to polyvinyl fluoride, polyvinyl chloride, polyvinylidene fluoride, polyvinylidene chloride, homopolymers and copolymers of other vinyls such as vinyl chloride and trifluorochloroethylene, copolymers of vinylidene fluoride and tetrafluoroethylene, copolymers of vinylidene fluoride and hexafluoropropylene, and terpolymers of, for example, vinylidene fluoride and hexafloropropylene and tetrafluoroethylene. These materials may be attached to carrier core particles by melting the coating material and fusing it to the carrier core particles. The adhesion of the carrier coating on the core depends, in large measure, on the melt rheology of the polymer, the dwell time that the carrier cores and the coating particles or resins are in the furnace and the temperature of the furnace. For example, polyvinylidene fluoride ($PVF_2$), available as Kynar ® from Pennwalt Corporation, may be heated from about 190° C. to about 265° C. with good melt rheology, but quickly discolors if overheated. Thermal decomposition occurs at about 375° C., releasing toxic anhydrous hydrogen fluoride gas. Polyvinyl fluoride (PVF), sold by DuPont under the trademark Tedlar ®, melts at about 190° C. and starts to decompose at about 210° C., also liberating hydrogen fluoride gas. The thermal processing latitude for PVF is less than for $PVF_2$. Coating with PVF is further complicated in that PVF is not soluble in substantially any solvent at room temperature.

SUMMARY OF THE INVENTION

It is an object of the invention to reduce the occurrence of thermal decomposition of coating materials such as PVF and $PVF_2$ and produce a more uniform carrier coating with good adhesion at lower temperature processing conditions.

It is also an object of the invention to be able to blend and use different coating materials on the same carrier particle.

It is a further object of the invention to reduce the amount of toxic gas production during the carrier particle coating process.

These and other objects are achieved by the present invention, in which small amounts of a latent solvent are present during the initial powder impaction of the powder coating process of electrostatographic carrier core particles. The temperature of the mixture is raised until the solvent softens the polymer, thereby making the coating uniform. This solvent is later evaporated to obtain the dry coated carrier. This process is especially useful when using coating materials which have a narrow thermal processing temperature range.

DETAILED DESCRIPTION OF PREFERRED EMBODIMENTS

Any suitable carrier core particles may be used in the present invention. Suitable materials for the core particles include, but are not limited to, iron, ferrite, magnetite, steel, nickel, aluminum, copper, carborundum, sodium chloride, ammonium chloride, aluminum potassium chloride, Rochelle salt, sodium nitrate, potassium chlorate, granular zircon, granular silicon, methyl methacrylate, glass, silicon dioxide, flintshot, and mixtures thereof. Depending on the electrostatographic method used, it is preferred that the material comprising the carrier core particle be selected from the group consisting of iron, ferrite, magnetite, steel and nickel. The carrier core particles prior to being coated with the coating preferably have an average diameter of about 25 microns to about 1,000 microns. The carrier core surface may be irregular, spherical, smooth, or rough. The carrier core may be hollow or solid.

Any suitable polymer coating material may be used. Preferred coating materials include but are not limited to fluorocarbons such as polyvinylfluoride, polyvinylidene fluoride, polytrifluoroethylene, chlorotrifluoroethylene, polytetrafluoroethylene, hexafluoropropylene and copolymers, terpolymers and mixtures thereof; natural resins such as caoutchouc, colophony, copal, damar, dragon's blood, jalop, storax, and mixtures thereof; thermoplastic resins including polyolefins such as polyethylene, polypropylene, chlorinated polyethylene and chlorosulfonated polyethylene; polyvinyls and polyvinylidenes such as polystyrene, polymethylstyrene, polymethylmethacrylate, polyacrylonitrile, polyvinylacetate, polyvinylalcohol, polyvinylbutyral, polyvinylchloride, polyvinylcarbazole, polyvinyl ethers, and polyvinyl ketones, polyvinylidene chloride, polyvinylidene cyanide, and copolymers, terpolymers, and mixtures thereof; thermoplastic polyamides such as polycaptrolactamo and polyhexamethylene adipimide; polyesters such as polyethylene terephthalate; polyurethanes; polysulfides; polycarbonates; and mixtures thereof; and thermosetting resins including phenolic resins such as phenol formaldehyde, phenol furfural and resorcinol formaldehyde; amino resins such as urea formaldehyde, and melamine formaldehyde; polyester resins; epoxy resins; and mixtures thereof; silicones, and cellulosic resins and polymers. Fluorocarbons are the preferred carrier coating materials because of their low surface energy and resistance to wear. The powdered polymer carrier coating material comprises about 0.005% to about 3% by weight of the carrier core particles, and more preferably about 0.1% to about 1% by weight of the carrier core particles.

The size of the powdered polymer carrier coating matrial particle ranges from about 0.1 microns to about 100 microns with a preferred range of about 0.5 microns to about 25 microns.

Any suitable coating, covering from about 1% to about 100% of the surface of the carrier core particles, with a preferred coverage of about 5% to about 90% of the surface of the carrier core particle, may be applied at a thickness of about 0.1 micron to about 25 microns. However, the carrier coating should cover enough of the surface of the carrier core particle and be thick enough to resist abrasion and prevent pinholes which adversely affect the triboelectric properties of the coated carrier particles.

To achieve further variation in the properties of the coating materials, well-known additives such as catalysts, curing agents, plasticizers, reactive and non-reactive polymers, dyes, pigments, fillers, wetting agents and mixtures thereof may be mixed with the coating material. Where a partially polymerized linear or crosslinked prepolymer is to be used as the coating material, polymerization may be completed in situ on the surface of the carrier by the application of heat. Some of the reactive materials may also act as latents solvents and become part of the coating.

Solvents which may used in this process include any suitable solvents which are latent solvents for the coating material. A latent solvent, as a rule, will not dissolve or substantially swell the powdered coating material at room temperature. The latent solvents which may be used are selected from the group including but not limited to hydrocarbons (aliphatic and aromatic), alcohols, esters, ketones, amides, aldehydes, amines, ethers, nitriles, halogenated hydrocarbons, acids, and bases. More specifically, latent solvents which may be used include, but are not limited to, acetophone, acetyl triethyl citrate, aniline, chlorophenyl resins, n-butyl levulinate, diallyl phthalate, dibenzyl ether, dibutyl fumarate, di-n-butyl maleate, dibutyl phthalate, di-n-butyl succinate, dibutyl tartrate, d(2-ethyl hexyl) phthalate, diethyl maleate, diethyl phthalate, diethyl sebacate, N,N-dimethyl acetate, dimethyl adipate, N,N-dimethyl formamide, dimethyl phthalate, dioctyl adipate, ethyl levulinate, isophorone, propylene carbonate, quinoline, O-toluidine, triacetin, tributyl citrate, tributyl phosphate, triethyl citrate, triethyl phosphate, mixed xylenes, methyl isobutyl ketone, butyl acetate, methyl isobutyl ketone, cyclohexanone, diacetone alcohol, diisobutyl ketone, butyrolactone, tetraethyl urea, carbitol acetate, and mixtures thereof. The amount of latent solvent added to the mixture should be about 3% to about 15% by weight percent of the mixture, with an optimum weight percent in the range of about 3% to about 5%.

The coating process involves dry mixing a quantity of carrier core particles with the coating material. This process step may be accomplished, for example, in a Patterson Kelly® (PK) mixer/coater or a Munson® blender. The polymer powder is impacted onto the carrier core surface and pore structure areas.

Alternative means of applying the coating material to the surface of the carrier core particles include cascade roll-milling or tumbling, milling, mixing, shaking, electrostatic powder cloud spraying, electrostatic disc processing employing an electrostatic curtain, and using a fluidized bed.

Following or prior to the dry coating of the carrier core particles with the coating material and any additives, a small quantity of a latent solvent is introduced. The carrier core particles with the impacted polymer powder, additives, and the latent solvent are mixed to obtain a uniform distribution of composition. Depending on the various parameters of the equipment and materials being used in this process, the latent solvent may be mixed with the core particles for about 1 minute to about 90 minutes.

The mixture of latent solvent, carrier core particles and coating material is heated to a temperature at which solution of the polymer in the solvent occurs, preferably while mixing —e.g., tumbling in a blender or mixer. The temperature at which the mixture may be heated ranges from about 50° C. to about 200° C., with an optimum range of about 75° C. to about 150° C., depending on the softening or melting properties of the coating material and the properties of the latent solvent. Usually, the temperature to which the mixture is heated is at least 25° C. below the temperature at which the coating material melts. It is preferred that the solvent be contained in the heating chamber during the solvation step to avoid excessive solvent loss due to evaporation. The solvent is contained in the heating chamber by keeping the heating chamber closed or sealed. It is advisable to take precautions to prevent undue pressure increases in the heating chamber.

After the heated coating material, carrier core and solvent have mixed for sufficient time for the coating material to coalesce and coat onto the carrier core particles, the chamber in which the solvent and the coated carrier core particles are mixed is vented to exhaust and evaporate the solvent. The temperature of the mixing chamber may be increased to accelerate solvent evaporation. Care must be taken not to increase the temperature of the mixing chamber too high, or else the coating may melt and degrade. It is preferable to connect a vacuum source to the heating chamber. This will reduce the pressure in the heating chamber and will assist in evaporating, drawing off and optionally recovering and recycling the solvent.

Following the removal of solvent from the heating chamber, the carrier particles may be distributed onto a heated tray so that any additional solvent trapped between the carrier particles may be evaporated. Recovery means may be employed to capture the vaporized solvent. The coating on the carrier core particles preferably has a thickness of about 1 micron to about 25 microns.

There are many variations to the method described above. For example, the carrier core, polymer powder, latent solvent and additives could be premixed together in a single batch in a mixer such as in a Littelford® blender, whereupon the mixture is fused in a tube furnace. The tube furnace could have a baffled zone to maintain a solvent vapor rich area to allow polymer solvation to occur. In this method, the solvent is evaporated as the mixture proceeds down the length of the tube furnace.

An additional advantage of this coating process is that different coatings, such as PVF and $PVF_2$, can be blended and used together in a carrier coating since many latent solvents for PVF will also dissolve $PVF_2$ at the same processing temperature. Such solvents include dimethyl phthalate, isophorone, propylene carbonate, and triethyl phosphate.

The coated carrier particles may be coated with any suitable pigmented or dyed electroscopic toner material. Typical toner materials include: gum sandarac, rosin, cumaroneindene resin, asphaltum, gilsonite, phenol-formaldehyde resins, methacrylic resins, polystyrene resins, polypropylene resins, epoxy resins, polyethylene resins, polyester resins, and mixtures thereof. The selection of particular toner material is within the capabilities of those of ordinary skill in the art, taking into account the separation of the toner particles from the coated carrier beads in the triboelectric series. The toner particles generally have a volume average particle diameter between about 1 and about 30 microns.

Any suitable toner concentration may be employed with the coated carrier particles of this invention. Typical toner concentrations for cascade and magnetic brush development systems include about 1 part by weight toner with about 10 to about 400 parts by weight of carrier.

Any suitable colorant such as a pigment or dye may be employed to color the toner particles. Toner colorants are well known and include, for example, carbon black, nigrosine dye, aniline blue, Calco Oil Blue, chrome yellow, ultramarine blue, quinoline Yellow, methylene blue chloride, phthalocyanines, malachite greene, lampblack, rose bengal, monastral red, Sudan Black BM, and mixtures thereof.

Preferably, the pigment is employed in an amount of from about 3 percent to about 20 percent by weight based on the total weight of the colored toner, allowing high quality images to be obtained. If the toner colorant employed is a dye, substantially smaller quantities of colorant may be used.

The developers resulting from combining the carrier with suitable toners may be used in any xerographic, ionographic or other imaging process.

EXAMPLE

About 1500 grams of 1000 Hoeganes Corp steel core particles having a volume average particle size between 120–500 microns and 10.5 grams of Tedlar® PV-116 polyvinylfluoride (PVF) powder having a volume average particle size of about 5 microns are dry blended together in a 1 quart glass jar for 15 minutes using a roller mill. This premixing results in the PVF being impacted onto the steel core surface. Fifteen milliliters of propylene carbonate (a latent solvent for PVF) are added to the mixture in the jar and the mixture is tumbled for an additional 15 minutes. The jar is then placed in an oven at 180° C. with the cap off but with a steel plate covering the jar opening so that the solvent is retained in the jar. The contents are heated for one hour with the steel plate lid in place and then for an additional 30 minutes with the lid removed to allow the solvent to evaporate. The mixture is poured onto a steel tray and heated for an additional hour to completely evaporate the solvent.

Another carrier coating is prepared as described above except that 0.42 grams of Black Pearls 2000 carbon black is added to the PVF powder and the mixture is blended to impact onto the carrier core surface. Propylene carbonate is added to the mixture and blended for one hour. The resultant mixture is heated as discussed above.

Each of the carriers is combined with a toner comprised of 79.5 parts styrene-butadiene (84% mole ratio styrene), 0.5 parts dimethyldistearyl aminomethylsulfate, 4.0 parts Regal 330 carbon black (Cabot), and 16.0 parts black magnetite (Columbian Chemical Company). Tone-detone measurements are conducted as described in U.S. Pat. No. 4,828,956, incorporated herein by reference. The measurement results are as follows, with the first number representing microcoulombs/gram of carrier, the number in parentheses representing the percent toner concentration, and N representing the number of tone/detone cycles.

| Carrier | N = 0 | N = 1 | N = 5 | N = 10 |
|---|---|---|---|---|
| Without Carbon Black | −21.3(2.80) | −22.8(2.84) | −22.9(2.78) | −22.3(2.80) |
| With Carbon Black | −7.4(2.82) | −8.8(2.72) | −8.2(2.63) | −8.0(2.64) |

The measurements show good triboelectric charge and stability through 10 cycles of tone-detone events. Carbon black added to the carrier coating is effective in reducing or lowering the charge. Reducing the carbon black loading from 4 weight percent may increase the triboelectric charge.

While the invention has been particularly shown and described with reference to preferred embodiments thereof, it will be understood by those skilled in the art that various changes in form and details may be made therein without departing from the spirit and scope of the invention.

What is claimed is:

1. A process for coating toner carrier core particles, comprising:

dry mixing said core particles with a polymer or resin coating material for said particles;

introducing either following or prior to said dry mixing step, a solvent which will not dissolve or substantially swell the coating material at room temperature but which will dissolve said coating material at a temperature above room temperature;

heating the core particles, coating material and solvent to a temperature at which said solvent dissolves said coating material; and removing solvent.

2. The process according to claim 1, wherein said mixture is pre-mixed to form a homogeneous composition before being introduced into a heating chamber.

3. The process according to claim 1, wherein said mixture is mixed to form a homogeneous composition in a heating chamber where said heating takes place.

4. The process according to claim 1, wherein said temperature is at least 25° C. below a melting temperature of said coating material.

5. The process according to claim 1, wherein solvent is removed by evaporation.

6. The process according to claim 1, wherein said core particles are dry coated with said coating material by a method selected from the group consisting of mixing, cascade roll-milling, cascade tumbling, milling, shaking, electrostatic powder cloud spraying, electrostatic disc processing, employing an electrostatic curtain, and using a fluidized bed.

7. The process according to claim 1, comprising mixing the solvent, the core particles and the coating material while heating.

8. The process according to claim 1, wherein the mixture is heated in a closed mixing chamber which limits the loss of solvent due to evaporation.

9. The process according to claim 8, wherein solvent is removed by venting the mixing chamber to exhaust and evaporate the solvent.

10. The process according to claim 9, further comprising increasing the temperature while venting the mixing chamber.

11. The process according to claim 1, wherein said solvent is removed with a vacuum assist.

12. The process according to claim 1, wherein the solvent is recaptured.

13. The process according to claim 1, wherein the coating material is comprised of a fluorocarbon.

14. The process according to claim 13, wherein the fluorocarbon is selected from the group consisting of polyvinylfluoride, polyvinylidene fluoride, polytrifluoroethylene, chlorotrifluoroethylene, polytetrafluoroethylene, hexafluoropropylene and copolymers, terpolymers and mixtures thereof.

15. The process according to claim 1, wherein the coating material is selected from the group consisting of natural resins, thermoplastic resins, partially cured thermoplastic resins, thermosetting resins, silicones, cellulosic resins, and cellulosic polymers.

16. The process according to claim 15, wherein the natural resin is selected from the group consisting of caoutchouc, colophony, copal, damar, dragon's blood, jalop, storax, and mixtures thereof.

17. The process according to claim 15, wherein the thermoplastic resin is selected from the group consisting of polyolefins; such as polyvinyls; polyvinylidenes; polyamides; polyesters; polyurethanes; polysulfides; polycarbonates; and mixtures thereof.

18. The process according to claim 15, wherein the thermosetting resin is selected from the group consisting of phenolic resins, amino resins, polyester resins, epoxy resins, silicones, and mixtures thereof.

19. The process according to claim 1, wherein said core particles comprise a material selected from the group consisting of iron, ferrite, magnetite, steel, nickel, aluminum, copper, carborundum, sodium chloride, ammonium chloride, aluminum potassium chloride, Rochelle salt, sodium nitrate, potassium chlorate, granular zircon, granular silicon, methyl methacrylate, glass, silicon dioxide, flintshot, and mixtures thereof.

20. The process according to claim 1, wherein the solvent is added in an amount of about 3 percent by weight to about 15 percent by weight of said mixture.

21. The process according to claim 1, wherein said solvent is selected from the group consisting of aliphatic hydrocarbons, aromatic hydrocarbons, alcohols, esters, ketones, amides, aldehydes, amines, ethers, nitriles, halogenated hydrocarbons, acids and bases.

22. The process according to claim 1, wherein said solvent is selected from the group consisting of acetophenone, acetyl triethyl citrate, aniline, chlorophenyl resins, n-butyl levulinate, diallyl phthalate, dibenzyl ether, dibutyl fumarate, di-n-butyl maleate, dibutyl phthalate, di-n-butyl succinate, dibutyl tartrate, d(2-ethyl hexyl) phthalate, diethyl maleate, diethyl phthalate, diethyl sebacate, N,N-dimethyl acetate, dimethyl adipate, N,N-dimethyl formamide, dimethyl phthalate, dioctyl adipate, ethyl levulinate, isophorone, propylene carbonate, quinoline, O-toluidine, triacetin, tributyl citrate, tributyl phosphate, triethyl citrate, triethyl phosphate, mixed xylenes, methyl isobutyl ketone, butyl acetate, cyclohexanone, diacetone alcohol, diisobutyl ketone, butyrolactone, tetraethyl urea, carbitol acetate, and mixtures thereof.

23. The process according to claim 1, wherein said solvent is selected from the group consisting of dimethyl phthalate, isophorone, propylene carbonate, and triethyl phosphate.

24. The process according to claim 1, further comprising mixing additional additives, wherein said additives are selected from the group consisting of catalysts, curing agents, plasticizers, reactive and non-reactive polymers, dyes, pigments, fillers, wetting agents, and mixtures thereof.

25. The process according to claim 24, wherein said additives are said solvents incorporated into the coating of the carrier core particles.

26. The process according to claim 1, wherein said coating material comprises about 0.005% to about 3% by weight of the core particles.

27. The process according to claim 1, wherein the core particles are coated to a coating thickness of about 0.1 micron to about 25 microns.

28. The process according to claim 2, wherein the mixture is heated in a tube furnace, said tube furnace having a baffled zone to maintain a solvent vapor rich area wherein the solvent dissolves said coating material.

29. The process according to claim 28, wherein solvent is removed by evaporation as the mixture proceeds down the tube furnace.

* * * * *